United States Patent [19]

Porth et al.

[11] Patent Number: 4,719,891

[45] Date of Patent: Jan. 19, 1988

[54] ELECTRONIC CONTROLLER FOR INTERNAL COMBUSTION ENGINES

[75] Inventors: Wolfgang Porth, Frankfurt am Main; Wolfgang Weibler; Eckhart Kern, both of Hofheim; Thomas Hannewald, Griesheim; Reiner Weingärtner, Hofheim, all of Fed. Rep. of Germany

[73] Assignee: VDO Adolf Schindling AG, Frankfurt am Main, Fed. Rep. of Germany

[21] Appl. No.: 926,454

[22] Filed: Nov. 3, 1986

[30] Foreign Application Priority Data

Nov. 2, 1985 [DE] Fed. Rep. of Germany ..... 3539012

[51] Int. Cl.[4] ..... F02B 3/00

[52] U.S. Cl. ..... 123/494; 123/472; 123/198 E; 123/647; 55/DIG. 28

[58] Field of Search ..... 123/198 E, 647, 494, 123/472; 55/DIG. 28

[56] References Cited

U.S. PATENT DOCUMENTS

| | | | |
|---|---|---|---|
| 3,811,419 | 5/1974 | Eckert | 55/DIG. 28 |
| 3,817,225 | 6/1974 | Priegel | 123/482 |
| 3,996,914 | 12/1976 | Crall | 123/198 E |
| 4,006,724 | 2/1977 | Carter | 123/198 E |
| 4,048,964 | 9/1977 | Kissel | 123/482 |
| 4,284,053 | 8/1981 | Merrick | 123/482 |
| 4,561,396 | 12/1985 | Sakamoto | 123/647 |

FOREIGN PATENT DOCUMENTS

| | | | |
|---|---|---|---|
| 40224 | 3/1980 | Japan | 123/647 |

*Primary Examiner*—Ronald B. Cox
*Attorney, Agent, or Firm*—Martin A. Farber

[57] ABSTRACT

In a system having an electronic controller for internal combustion engines, particularly injection engines in which the controller is functionally connected to a plurality of sensors and at least one actuator, the controller is part of an assembly which furthermore comprises a throttle-valve arrangement, an air-mass sensor and a throttle-valve position sensor. In systems with central injection, the injection valve can also be arranged within the assembly. By the compact structural unit thus obtained, cable connections are reduced to a minimum, so that, in their turn, reliability is increased and expense is saved. Furthermore, the arrangement facilitates maintenance and repair.

11 Claims, 4 Drawing Figures

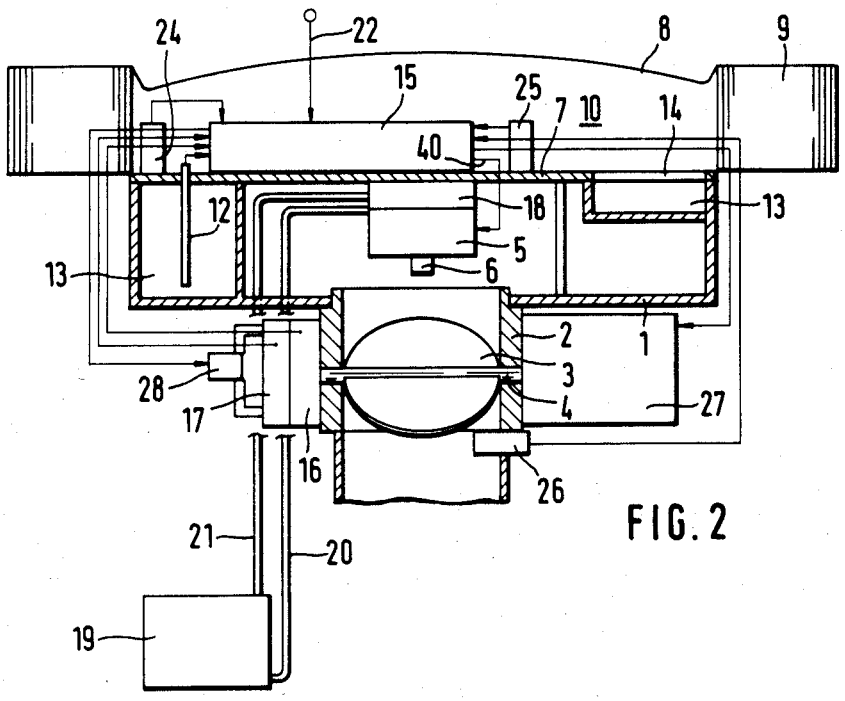
FIG. 2
FIG. 3
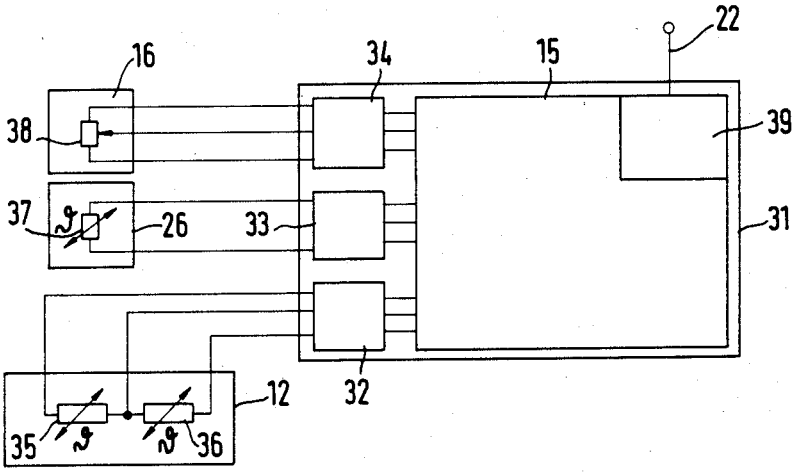

ELECTRONIC CONTROLLER FOR INTERNAL COMBUSTION ENGINES

FIELD AND BACKGROUND OF THE INVENTION

The invention concerns a system having an electronic controller for internal combustion engines, particularly injection engines, in which the controller is functionally connected to a plurality of sensors and at least one actuator.

Electronic control systems for internal combustion engines consist of a plurality of components such as, for instance, sensors, the controller and actuators, which in known systems are distributed on the internal combustion engine and/or in the engine compartment of an automotive vehicle. In this way, corresponding plug-in connections and lines are necessary, which can give rise to disturbances. Furthermore, the plug-in connections and the lines represent a further expense. In addition, there are a corresponding number of protective housings or caps which protect the components, or at least the connections of the components, from external influences (moisture, dirt).

SUMMARY OF THE INVENTION

It is an object of the present invention therefore to provide a system having an electronic controller for internal combustion engines in which lines and plug-in connections are reduced to a minimum.

According to the invention, the controller (15) is part of an assembly which furthermore comprises a throttle-valve arrangement (3,4), an air-mass sensor (12) and a throttle-valve position sensor (16).

Aside from the advantage that long connecting lines which are subject to faults are eliminated, there is the advantage that the closed assembly can be removed from the internal combustion engine for maintenance and repair and be calibrated, for instance, on a test bench.

According to a further development of the invention, a housing (1) can be connected to the intake port of the internal combustion engine, the throttle-valve arrangement (3,4) is provided in a length of pipe (4) which forms the connection between housing (1) and intake port, and the air-mass sensor (12) is arranged in the housing (1) while the controller (15) is arranged on a wall (7) of the housing (1). This development permits an extremely favorable connection of the assmebly to the internal combustion engine.

Another further development is that within the housing (1) there is arranged an injection valve (5) which is associated as actuator wtih the controller (15). This development can be advantageously employed in injection engines with so-called central injection in which merely one injection valve is provided for all the cylinders. However, the invention can also be advantageously used in internal combustion engines in which an inject in valve is provided for each cylinder.

A further improvement of the invention is that an air filter arrangement (8) which has a circular air filter (9) is arranged on an outer wall (7) of the housing (1) and that the inner space formed by the circular air filter (9) is connected to the inside of the housing (1) by a flow channel (13) within which the air-mass sensor (12) is arranged.

Another favorable embodiment is possible here in which the electronic controller (15) is arranged on the outer wall (7) of the housing (1) and extends into the inside (10) of the air-filter arrangement (8).

In this way, good cooling of the electronic controller is provided by the filtered air which is drawn in.

In accordance with another feature, a pressure sensor (24) and/or temperature sensor (25) can furthermore be arranged in the interior (10) of the air-filter arrangement (8).

Furthermore, it is possible to provide an engine-temperature sensor (26) and/or an intake manifold temperature sensor (26) within the region of the throttle-valve arrangement (3,4).

According to another embodiment, the shaft (4) which bears the throttle valve (3) is operatively connected to a switch (17) which responds at the idle position of the throttle valve (3).

Further circuits (32, 33, 34) corresponding to respective sensors (12, 16, 26) are combined spatially with the electronic controller (15) but functionally represent assemblies which are separate from the electronic controller.

Still further, electric circuits corresponding to respective sensors (12, 16, 26) are combined both spatially and functionally with the electronic controller (15).

Also, the injection valve (5) can be combined with a system-pressure controller (18).

The arrangement in accordance with the invention can be used in different control systems for internal combustion engines. A preferred use is the known control of the amount of fuel injected in Otto engines with fuel injection. For the regulating of the amount injected, the known control systems primarily utilize the mass of air drawn in by the engine. However, for the control, there are also taken into account the position of the throttle valve, the external air pressure (i.e. the altitude), the engine temperature, the temperature of the outside air, the speed of rotation of the engine and the result of the measurement provided by a lambda probe. A plurality of sensors which detect these variables can be arranged within the assembly in the arrangements according to the invention. However, additional sensors (for instance speed of rotation of the engine, lambda probe) can also be connected to the assembly by suitable lines.

The known control systems also permit the electronic controller (15) to contain an idling control on the output of which an idling setter (28) is provided in the region of the throttle-valve arrangement (3, 4).

Further, the arrangement of the invention is not limited to mechanical actuation of the throttle valve. One embodiment of the invention rather resides in the fact that the electronic controller (15) comprises a controller of an electronic gas-pedal system and that the throttle-valve arrangement (3,4) is provided with an electromotive actuator (27) which is connected to an output of the electronic controller (15) intended for this purpose.

The lines between the sensors present (12, 16, 17, 24–26) as well as actuators (5, 27, 28) and the electronic controller (15) can advantageously extend, at least in part, within the housing (1).

Further sensors and/or actuators arranged spatially outside of the assembly can be connected to the electronic controller.

BRIEF DESCRIPTION OF THE DRAWINGS

With the above and other objects and advantages in view, the present invention will become more clearly understood in connection with the detailed description of preferred embodiments, when considered with the accompanying drawings, of which:

FIG. 2 is a view similar to FIG. 1 of a embodiment having a plurality of sensors; and FIG. 3 is a diagrammatic showing of the controller and of the sensor circuits.

DETAILED DESCRIPTION OF THE PREFERRED EMBODIMENT

Identical parts have been provided with the same reference numbers in the figures.

Figure 1:
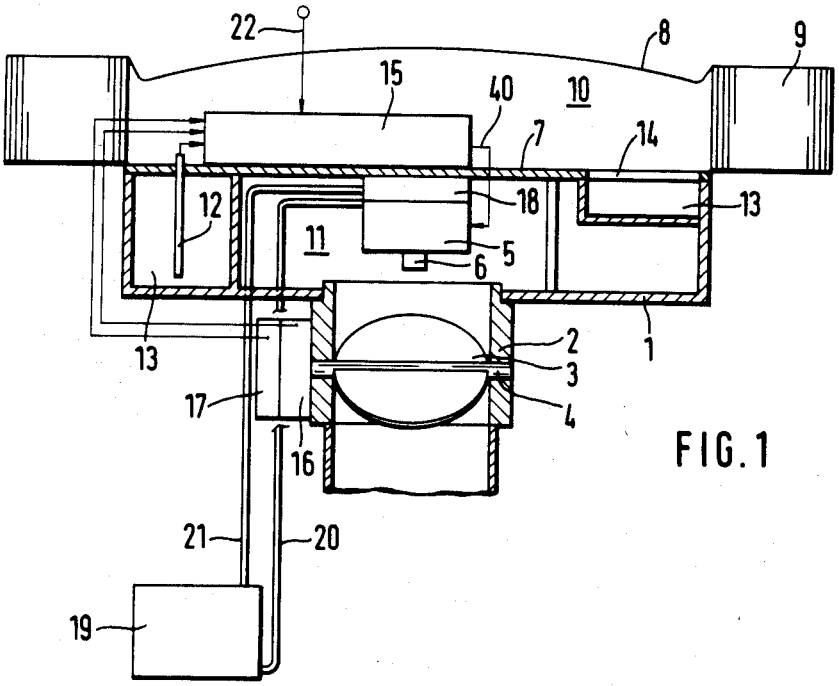
FIG. 1 is a longitudinal sectional view of a first embodiment in which the only sensors are an air-mass sensor and a throttle-valve position sensor.

In the arrangement shown in FIG. 1, a housing 1 having the shape of a squat cylinder is placed on a pipe 2 which contains a throttle valve 3 which is fastened on a shaft 4. A fuel injection valve 5 having a nozzle 6 is arranged above the mouth of the pipe 2. The housing 1 is closed off on the top by a wall 7 on which an air filter 8 is placed. The air filter 8, which is known per se, consists of an annular filter 9 which forms a hollow space 10. The inside space 10 of the air filter as well as the inside 11 of the housing 1 are connected by a flow channel 13. The flow channel contains an air-mass sensor 12 and is relatively long in order to obtain the best possible laminar flow. In order to achieve this in a small space, the flow channel 13 extends in annular shape along the outer wall of the housing 1. The filtered air enters the flow channel 13 at the inlet opening 14, which, at the same time, represents an opening in the wall 7, and then flows past the sensor 12 and is conducted, via the outlet opening 14*a*, into the rest of the hollow space 11 of the housing 1. The hollow space 11 furthermore serves to dampen the pulsation in the intake port.

An electronic controller 15 is located on the partition wall 7, the controller being of known operation and therefore not having to be described here in detail. The measurement signals of the air-mass sensor 12 and of a throttle-valve position sensor 16 are fed as input variables to the electronic controller 15. The throttle-valve position sensor 16 consists, in known manner, of a potentiometer whose wiper is coupled to the throttle-valve shaft 4. Furthermore a switch 17 for the switching of the control for idling operation is connected, also in known manner, to the throttle-valve shaft 4 and to the electronic controller 15.

The output signals of the controller 15 are fed to the fuel injection valve 5 via short lines. In the embodiment shown in the drawing, the fuel injection valve 5 is combined with a system-pressure controller 18. The fuel feed line 20 and the fuel return line 21 serve for connection with a fuel tank 19. Finally, operating voltage is fed to the controller 15 via an electric line 22, which is also merely diagrammatically shown. In order to avoid any effect of variations in the voltage of the automobile electrical system on the controller, the controller 15 is provided with a voltage stabilization circuit (not shown in FIG. 1).

Figure 1A:
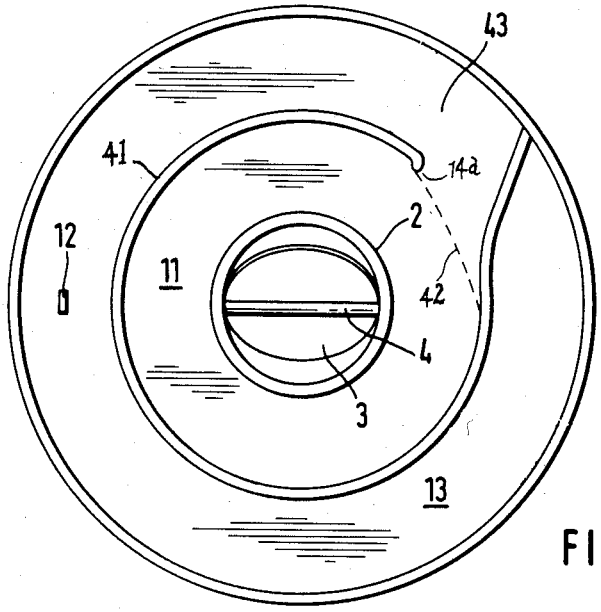
FIG. 1*a* is a cross-section through the housing of FIG. 1.

In order to make the course of the flow channel clear, FIG. 1*a* shows a cross section through the housing 1 in which there is also shown a flow straightener 41 and a protective grating 42 which have been omitted from FIG. 1 for the sake of clarity.

The embodiment according to FIG. 2 presupposes a control system having a plurality of possibilities. For this purpose, controller 15 is provided not only with the input variables explained in connection with FIG. 1 but also with information concerning the pressure of the outer air, i.e. the altitude, via a pressure sensor 24 which is located in the space 10 of the air filter 8.

A temperature sensor 25 which determines the temperature of the outside air is also present in the space 10 of the air filter 8.

For various known control systems the motor temperature is required as one of the input variables. For this purpose, in the system according to the invention, in place thereof the intake-manifold temperature in the vicinity of the throttle-valve arrangement can be detected by another sensor 26.

Finally the control system can also comprise a so-called electronic gas-pedal system in which the position of the gas pedal is converted into an electric variable which acts on the throttle-valve via a controller. The controller 15 can be suitably designed for this purpose and have an additional output to which an electromotive throttle-valve actuator 27 is connected.

FIG. 3 shows the electrical circuit of the arrangements of FIGS. 1 and 2 diagrammatically, in part as block diagram. Some of the sensors concerned require, for their operation, electric circuits which are specifically adapted to the nature of the sensors. Sensors are also known which give off very small electrical signals which must be amplified before they are further used. For this purpose, electric circuits are frequently arranged directly on the sensors. Due to the compact construction of the arrangement in accordance with the invention, it is possible to combine such circuits with the controller 15 within a housing 31.

Depending on the specific use, it may be advantageous to develop the circuits corresponding to the individual sensors—referred to below as sensor circuits—in each case as separate modules 32, 33, 34 which are connected to the controller 15 and the respective sensors 12, 26, 16 merely by a few lines. This arrangement has the advantage that when the system of the invention is adapted to, for instance, different internal combustion engines for which different sensors are required, merely one or more of the units 32, 33, 34 need be replaced. The connecting of the corresponding sensors circuit 32, 33, 34 to the controller 15, which, at the same time, also takes over the supplying of the sensor circuits with the operating voltage, is effected, in principle, by three lines. Two of them are used for the operating voltage and the ground connection respectively while the third is used for conducting the output signal of the corresponding sensor circuit to the controller 15. This line can conduct an analog signal of the measurement variable or, in the event of digital signal processing within the controller, also a digital signal. In such case, an analog-digital converter would have to be provided in the sensor circuit.

Three sensors are present in the arrangement shown in FIG. 3. The air-mass sensor 12 consists of a first temperature-dependent conductor 35 and a second temperature-dependent comparison conductor 36. The two conductors are bathed by the stream of air. The conductor 35 is heated to a constant temperature which is substantially above the temperature of the air by a current which is fed from the sensor circuit 32. The sensor circuit 32 contains a controller circuit in which the temperature is detected by the temperature dependence of the resistance of the resistor 35 and the current fed to the resistor 35 is controlled so as to maintain the temperature constant. The value of the current is then a measure of the air mass. In order to compensate for the influence of the temperature of the air, a comparison conductor is arranged in the vicinity of the conductor 35, said comparison conductor however being passed through by a small current so that, for all practical purposes, it is not heated above the air temperature. A temperature-dependent resistor 37 which serves, for instance, as motor or intake-pipe temperature sensor 26 is connected to the sensor circuit 33. It is part of a bridge circuit which is furthermore arranged in the sensor electronics 33.

Finally, the sensor circuit 34 is connected to a potentiometer 38 which serves as throttle-valve position indicator. Within the housing there is also arranged a known voltage stabilization circuit 39 which is connected to the automobile electrical system via the input 22 and provides a stabilized operating voltage for the controller 15 as well as for the sensor circuits 32, 33, 34. The output 40 of the controller 15 is connected to the injection valve 5 (FIG. 1, FIG. 2).

In other cases it may be more favorable to integrate the sensor circuits 32, 33, 34 in the controller 15 rather than to develop them as separate units. This has the advantage that the solder or plug connections between the units 32, 33, 34 and the controller 15 can also be dispensed with. In such cases changes in the controller 15 itself would be necessary in order to adapt the contoller 15 to the different sensors.

We claim:

1. In a system having an electronic controller for an internal combustion engine, particularly injection engines, in which the controller is functionally connected to a plurality of sensors and at least one actuator, the improvement comprising:

an assembly including the controller; and wherein the assembly further comprises:

a throttle-valve mechanism, an air-mass sensor, a throttle-valve position sensor and an injection valve;

a length of pipe;

a housing connected to an intake port of the internal combustion engine by said length of pipe; and wherein said throttle-valve mechanism is provided in said length of pipe; and an air filter assembly which has a circular air filter and is located on an outer wall of the housing; and wherein a flow channel connects an inner space of the filter assembly, formed by the circular air filter, to the inside of the housing, said air-mass sensor being located within said flow channel; and wherein the electronic controller is located on the outer wall of the housing and extends into the inside of the air-filter assembly.

2. The system as set forth in claim 1, wherein said air-mass sensor is located in said housing while the controller is positioned on a wall of the housing.

3. The system as set forth in claim 1, further comprising a set of sensor including a pressure sensor and temperature sensor, the set of sensors being located in the interior of the air-filter assembly.

4. The system as set forth in claim 2, further comprising a set of sensors including an engine-temperature sensor and an intake manifold temperature sensor, the set of sensors being disposed within the region of the throttle-valve mechanism.

5. The system as set forth in claim 2, further comprising a switch, and wherein said throttle valve mechanism includes a throttle valve and a shaft which carries said throttle valve and is operatively connected to said switch, said switch being responsive to an idle position of said throttle valve.

6. The system as set forth in claim 1, wherein said electronic controller contains an idling control, there being an idling setter coupled to an output of the idling control and located adjacent said throttle-valve mechanism.

7. The system as set forth in claim 1, wherein said electronic controller comprises a controller of an electronic gas-pedal system, and said throttle-valve mechanism comprises an electromotive actuator, and said electronic controller includes an output connected to said electromotive actuator.

8. The system as set forth in claim 1, wherein said housing encloses said controller; and wherein electric signal lines are provided between individual ones of said sensors as well as said at least one actuator for connection with said electronic controller, said lines extending, at least in part, within said housing.

9. The system as set forth in claim 1, further comprising sensors which are arranged spatially outside of the assembly and are connected to the electronic controller.

10. The system as set forth in claim 1, further comprising actuators which are arranged spatially outside of the assembly and are connected to the electronic controller.

11. The system as set forth in claim 1, further comprising sensors and actuators which are arranged spatially outside of the assembly and are connected to the electronic controller.

* * * * *